US010571189B2

(12) United States Patent
Van De Rijt et al.

(10) Patent No.: US 10,571,189 B2
(45) Date of Patent: Feb. 25, 2020

(54) SYSTEM AND METHOD FOR OPERATING A LIQUEFACTION TRAIN

(71) Applicant: SHELL OIL COMPANY, Houston, TX (US)

(72) Inventors: Jeroen Van De Rijt, Amsterdam (NL); Pierre Christian Marie Carrette, Seria (BN); Hossein Khajavi, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 126 days.

(21) Appl. No.: 15/850,250

(22) Filed: Dec. 21, 2017

(65) Prior Publication Data

US 2019/0195555 A1 Jun. 27, 2019

(51) Int. Cl.
*F25J 1/02* (2006.01)
*F25J 1/00* (2006.01)

(52) U.S. Cl.
CPC ..... *F25J 1/0252* (2013.01); *F25J 1/0022* (2013.01); *F25J 1/0052* (2013.01); *F25J 1/0055* (2013.01); *F25J 1/0087* (2013.01); *F25J 1/0212* (2013.01); *F25J 1/0214* (2013.01); *F25J 1/0216* (2013.01); *F25J 1/0218* (2013.01); *F25J 1/0248* (2013.01); *F25J 1/0254* (2013.01); *F25J 1/0292* (2013.01); *F25J 1/0298* (2013.01); *F25J 2205/02* (2013.01); *F25J 2270/66* (2013.01); *F25J 2280/20* (2013.01); *F25J 2280/50* (2013.01)

(58) Field of Classification Search
CPC ..... F25J 1/0022; F25J 1/0252; F25J 1/0254; F25J 1/0243; F25J 2280/02; F25J 2280/50
See application file for complete search history.

(56) References Cited

U.S. PATENT DOCUMENTS

| | | | | |
|---|---|---|---|---|
| 4,172,711 | A * | 10/1979 | Bailey | F25J 1/0022 62/619 |
| 4,504,296 | A | 3/1985 | Newton et al. | |
| 6,253,574 | B1 | 7/2001 | Stockmann et al. | |
| 6,272,882 | B1 * | 8/2001 | Hodges | F25J 1/0022 62/613 |
| 8,736,061 | B2 * | 5/2014 | Johnson | H01L 27/0207 257/201 |
| 2005/0056051 | A1 | 3/2005 | Roberts et al. | |
| 2019/0120548 | A1 * | 4/2019 | Pierre, Jr. | F25J 1/0022 |

FOREIGN PATENT DOCUMENTS

| | | | |
|---|---|---|---|
| DE | 3521060 | A1 | 12/1985 |
| EP | 1340951 | A2 | 9/2003 |
| WO | 0181845 | A1 | 11/2001 |
| WO | 2006009646 | A2 | 1/2006 |
| WO | 2015076975 | A2 | 5/2015 |

* cited by examiner

*Primary Examiner* — Brian M King

(57) ABSTRACT

A method for operating a main cryogenic heat exchanger for use in a natural gas liquefaction process, involves monitoring or predicting variations in the flow rate of a feed gas stream provided to the main cryogenic heat exchanger. When a variation of the flow rate exceeding a predetermined threshold value is monitored or predicted, a control scheme is started to control one or more compressor recycle valves in response to the monitored or predicted variation of the flow rate to recycle part of a compressed mixed refrigerant stream in a refrigerant loop.

13 Claims, 5 Drawing Sheets

SYSTEM AND METHOD FOR OPERATING A LIQUEFACTION TRAIN

FIELD OF THE INVENTION

The present invention is directed to a method of operating a main cryogenic heat exchanger and a system arranged therefore.

BACKGROUND TO THE INVENTION

Natural gas can be liquefied for purposes of storage and transportation, as it is occupying a smaller volume in liquid state than in gaseous state. Typically, before being liquefied, the natural gas is treated to remove contaminants (such as $H_2O$, $CO_2$, $H_2S$ and the like) and heavy hydrocarbon molecules, which may freeze out during the liquefaction process.

Liquefaction of natural gas is an energy consuming process. Designing and operating liquid natural gas plants in the most efficient manner is therefore a constant focus area.

U.S. Pat. No. 4,504,296 A describes a process for liquefying a natural gas stream using Dual Mixed Refrigerant (DMR) cycles. The first and second cooling stages are against a mixed multicomponent refrigerant composed of methane, ethane, propane, butane and nitrogen.

EP 1 340 951 A2 describes a process for liquefying a natural gas stream using multiple refrigerant cycles. The first and second cooling stages are against a Mixed Refrigerant (MR) while the third cooling stage can be against nitrogen. The second cooling stage is carried out in a single heat exchanger at a single pressure of mixed refrigerant.

US 2005/056051 describes a process for liquefying a natural gas stream using multiple refrigerant cycles. The first cooling stage is against a propane refrigerant, the second cooling stage is against MR and the third cooling stage can be against nitrogen. The second cooling stage is carried out in a single heat exchanger at a single pressure of MR.

DE 3521060 describes a process for liquefying a natural gas stream using three refrigerant cycles. The first and third cooling stages are against a MR or propane refrigerant, while the second cooling stage is against a MR. There is no disclosure of the use of at least two heat exchangers operating at different pressures of MR in the second cooling stage.

U.S. Pat. No. 6,253,574 B1 describes a process for liquefying a natural gas stream using a MR cascade cycle of three-MR cycles having different refrigerant compositions. The refrigerant for the first cycle is a mixture of ethylene or ethane, propane and butane. The refrigerant for the second cycle is a mixture of methane, ethylene or ethane and propane, and the third refrigerant is a mixture of nitrogen, methane and ethylene or ethane. The use of MR can have some advantages in certain situations, for example in a large Main Cryogenic Heat Exchanger (MCHE), which is efficient when cooling to below −100° C.

WO201576975 describes a method of retrofitting a full-scale Liquefied Natural Gas (LNG) plant to enhance the LNG production capacity of the LNG plant. A small-scale LNG plant having a capacity less than 2 MTPA can be integrated with a main LNG plant having a capacity of at least 4 MTPA such that end flash gas and boil off gas from the main LNG plant can be liquefied by the small-scale LNG plant as incremental LNG. According to WO201576975 the production capacity of the integrated system can be improved by increasing the temperature of the gas stream exiting the MCHE of the main LNG plant between 5° C. and 30° C. as compared with the design temperature.

WO2006009646 is related to hydrocarbon fluid processing plants, methods of designing hydrocarbon fluid processing plants, methods of operating hydrocarbon fluid processing plants, and methods of producing hydrocarbon fluids using hydrocarbon fluid processing plants. More particularly, some embodiments of the invention are related to natural gas liquefaction plants, methods of designing natural gas liquefaction plants, methods of operating natural gas liquefaction plants and methods of producing LNG using natural gas liquefaction plants. One embodiment of the invention includes a hydrocarbon fluid processing plant including a plurality of process unit module types, the plurality of process unit module types including at least a first process unit module type including one or more first process unit modules and a second process unit module type including two or more integrated second process unit modules wherein at least one of the first process unit modules and at least one of the second process unit modules are sized at their respective substantially maximum processing efficiency.

WO2001081845 A1 relates to controlling the production of a liquefied natural gas product stream comprises steps of a) measuring the temperature and the flow rate of the liquefied natural gas product stream and measuring the flow rates of the Heavy Mixed Refrigerant (HMR) and of the Light Mixed Refrigerant (LMR); b) selecting the flow rate of one of the refrigerants (HMR, LMR or the total mixed refrigerant) to have an operator manipulated set point, and generating a first output signal for adjusting the flow rate of HMR and a second output signal for adjusting the flow rate of the LMR c) adjusting the flow rates of the HMR and LMR in accordance with the first and second output signals; d) determining a dependent set point for the ratio of the flow rate of the liquefied natural gas product stream to the flow rate of one of the refrigerants such that the temperature of the liquefied natural gas product stream is maintained at an operator manipulated set point; e) maintaining the flow rate of the liquefied natural gas product stream at its dependent set point.

It is an object to improve the dynamic response of a refrigerant loop associated with a main cryogenic heat exchanger (MCHE) to relatively fast flow rate changes/variations in the feed stream (typically natural gas) of the main cryogenic heat exchanger. There is a need for such a dynamic response in situations where relatively fast flow changes/variations in the (natural) gas feed circuit occur (frequently). Relatively fast herein may mean, for instance, losing 30% vol. or more of the feed in a time frame of 1 to 2 minutes.

Such relatively fast flow rate changes/variations may for instance occur when upstream equipment fails unexpectedly. Also, such relatively fast flow rate changes/variations may occur in situations in which the feed gas stream is (partially) obtained from (the pretreatment unit of) one or more different liquefaction trains or LNG trains, in case one of those parallel liquefaction trains trip.

If not controlled well, the liquefaction train may trip and/or equipment may be damaged. Both cases typically result in significant costs and therefore losses, the first due to lost production and the second for replacement of relatively expensive equipment. For instance, liquid refrigerant (for instance MR) may drop out of the MCHE. For instance, this may lead to compressor for the refrigerant to trip. If the (resulting in train trip and restart, flaring) and large temperature gradients in the MCHE may occur, hence MCHE tube leaks. An example application is a common liquefaction unit (CLU), fed by treated gas from various in-plant (train) feed sources, considering that the feeding trains trip more often.

SUMMARY

It is an aim to provide an improved response to fast transients, improving the reliability of the critical equipment in the LNG plant and reduce the occurrence of damage thereto, in particular the main cryogenic heat exchanger. Such damage may result in downtime to repair and associated costs.

It is a further aim to provide a method of operating a main cryogenic heat exchanger that allows for a fast automatic dynamic response to variations of the flow rate of the feed gas to the main cryogenic heat exchanger.

In one aspect, the present invention is directed to a method of operating a main cryogenic heat exchanger for use in a natural gas liquefaction process, the method comprising receiving a feed gas stream at an inlet of the main cryogenic heat exchanger at a flow rate, cycling a mixed refrigerant through a refrigerant loop, the refrigerant loop comprising at least a refrigerant compressor unit comprising a suction side and a discharge side, wherein cycling comprises discharging a compressed mixed refrigerant stream from the discharge side and passing the mixed refrigerant through the main cryogenic heat exchanger to allow the mixed refrigerant to exchange heat with the feed gas stream in the main cryogenic heat exchanger and thereby cool the feed gas stream, wherein the method further comprises monitoring or predicting variations in the flow rate of the feed gas stream and in case a variation of the flow rate exceeding a predetermined threshold value is monitored or predicted, starting a control scheme which control scheme comprises controlling one or more compressor recycle valves in response to the monitored or predicted variation of the flow rate to recycle part of the compressed mixed refrigerant stream from the discharge side to the suction side of the compressor unit.

According to a further aspect there is provided a system arranged to perform the above method.

According to a further aspect there is provided a system for use in a natural gas liquefaction process, the system comprising a main cryogenic heat exchanger for receiving a feed gas stream at an inlet of the main cryogenic heat exchanger at a flow rate, a refrigerant loop comprising at least a refrigerant compressor unit comprising a suction side and a discharge side, wherein the refrigerant loop is arranged to cycle a mixed refrigerant through the refrigerant loop, wherein cycling comprises discharging a compressed mixed refrigerant stream and passing the mixed refrigerant through the main cryogenic heat exchanger to allow the mixed refrigerant to exchange heat with the feed gas stream in the main cryogenic heat exchanger and thereby cool the feed gas stream, the refrigerant loop further comprising one or more compressor recycle valves and associated recycle lines arranged to recycle part of the compressed mixed refrigerant stream, wherein the system further comprises a controller arranged to monitor or predict variations in the flow rate of the feed gas stream, determine a monitored or predicted variation of the flow rate exceeding a predetermined threshold value and in response thereto start a control scheme which control scheme which control scheme comprises controlling the one or more compressor recycle valves in response to the monitored or predicted variation of the flow rate to recycle part of the compressed mixed refrigerant stream.

The refrigerant compressor unit may comprise one or more compressors positioned in series and/or parallel with one or more water or air-cooled inter/aftercoolers positioned downstream of the compressors. The refrigerant compressor unit may comprise a liquid knock-out vessel positioned upstream of the compressors to prevent liquid entering the compressors.

The compressor recycle valve is part of a recycle line connecting a discharge side of the refrigerant compressor unit to a suction side of the refrigerant compressor unit, preferably upstream of the liquid knock-out vessel and downstream of the main cryogenic heat exchanger. The discharge side is preferably downstream of the aftercoolers and upstream of any heat exchangers or separation vessels positioned downstream of the refrigerant compressor unit.

In case the refrigerant compressor unit comprises two or more compressors positioned in series, the recycle line may connect a discharge side of one of the compressors to a suction side of that same compressor or to a suction side of another compressor upstream thereof. In such as a case, each compressor in the refrigerant compressor unit may have an associated recycle valve and recycle line connecting a discharge side of the compressor to a suction side of the compressor.

Controlling the recycle valve(s) means controlling the recycle valves to be in a closed position, in a fully opened position or in an intermediate position in between the closed position and the fully opened position.

The term flow rate as used here refers to mass flow rate (for example measured in SI as kg/s) and/or volumetric flow rate (SI: $m^3/s$). The predetermined threshold value may be a relative value (e.g. expressed in %) or an absolute value (e.g. expressed in kg/s). In a particular embodiment the variation of the flow rate exceeding a predetermined threshold value is a decrease of the flow rate exceeding a predetermined decrease threshold value. In another embodiment, the threshold value to be exceeded is a rate-of-change of the mass and/or volumetric flow rate (kg/s per second). In another embodiment, the threshold is a combination of a threshold of flow rate and a threshold of the rate of change of a flow rate. In another embodiment, the threshold is a combination of the time span a threshold rate of change of flow rate is exceeded.

The control scheme may be executed by a controller. The controller may be arranged to obtain the required input, such as an indication of the flow rate of the feed gas stream, perform required computations, such as determining variations in the flow rate and/or the rate of change of the flow rate and comparing against the predetermined threshold value, and generate control signals to control the compressor recycle valve(s) and send the control signals to the compressor recycle valve(s). The control scheme is preferably triggered automatically, without any operator interaction. Once triggered, the control scheme preferably runs automatically without requiring any operator interaction or operator input. The control scheme may be stopped by an operator or may be stopped automatically once the flow rate of the feed gas stream reaches a predetermined feed value or the opening of the recycle valve(s) drops below a predefined threshold opening, which may be in the range of 0-20% of the maximum recycle valve(s) opening or 0-20% of the maximum flow rate through the valve when fully opened. The predetermined feed value is preferably associated with normal operation conditions.

The feed gas stream is passed through the main cryogenic heat exchanger through a plurality of gas tubes.

The term main cryogenic heat exchanger may refer to coil wound heat exchangers, plate-fin heat exchangers and any other suitable type of heat exchanger.

BRIEF DESCRIPTION OF THE DRAWINGS

The drawings depict one or more implementations in according with the present teachings, by way of example only, not by way of limitation. In the figures, like reference numerals refer to the same or similar elements. Furthermore, a single reference number will be used to identify a conduit or line as well as the stream conveyed by that line.

DETAILED DESCRIPTION

Figure 1:
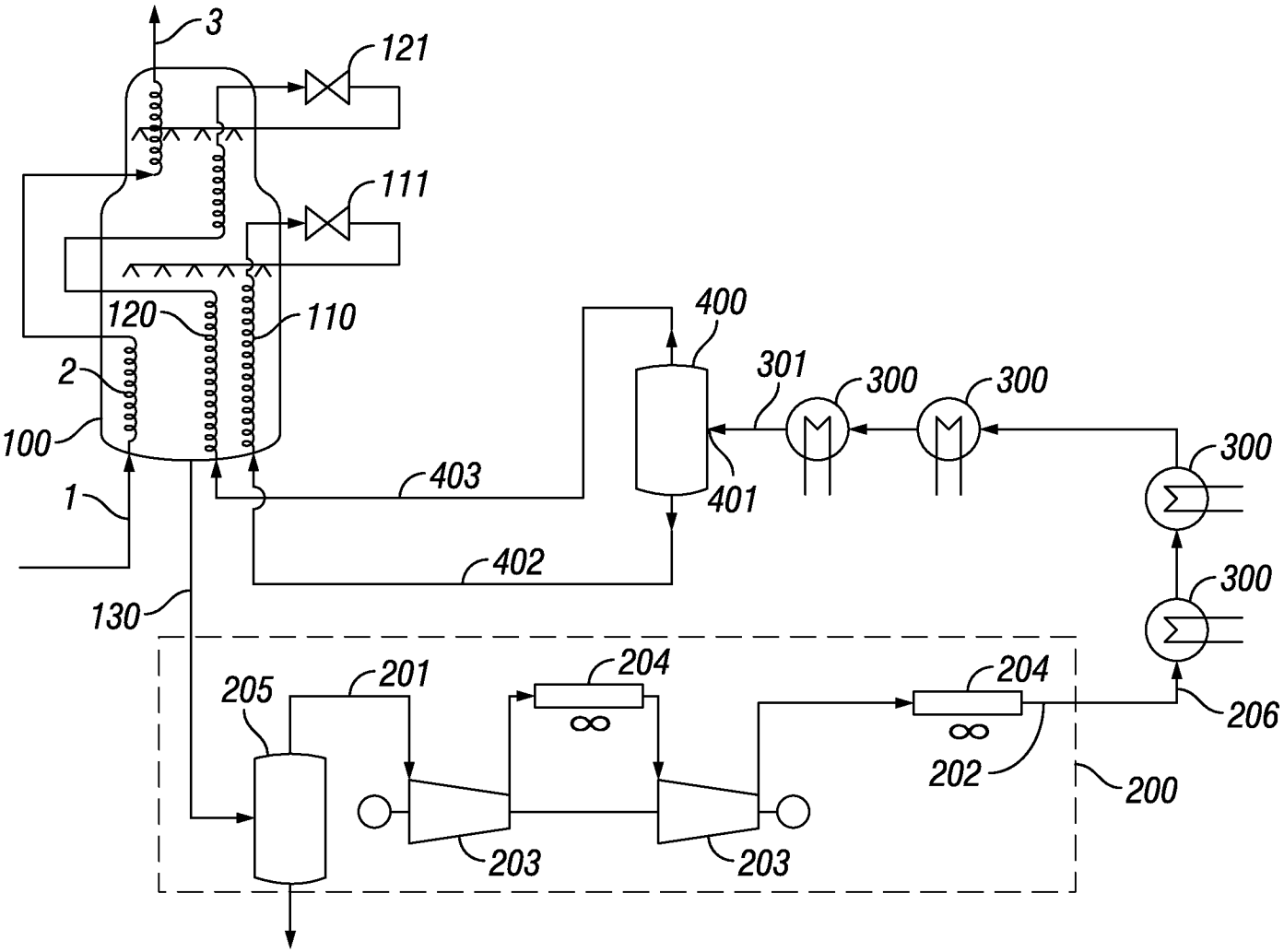
FIG. 1 is a schematic illustration of a main cryogenic heat exchanger and the associated refrigerant loop.

The following examples of certain aspects of some embodiments are given to facilitate a better understanding of the present invention. In no way should these examples be read to limit, or define, the scope of the invention.

Where in this text reference is made to a recycle valve, this also encompasses situations in which two or more recycle valves are present. This will be described in more detail below.

The embodiments described below relate to a main cryogenic heat exchanger being a coil wound heat exchanger. It will be understood that this is by way of example and other suitable types of heat exchangers may be used as well.

The embodiments provided in this text aim to improve the dynamic response of a refrigerant loop comprising a mixed refrigerant to provide cooling duty to a main cryogenic heat exchanger, to fast flow rate changes in the feed (natural) gas stream received at the inlet of the main cryogenic heat exchanger in an LNG plant, in particular fast flow rate reductions. This is thus of particular interest where relatively fast flow rate changes in the (natural) gas circuit occur (frequently). If not controlled well, liquid mixed refrigerant may drop out from the shell side of the main cryogenic heat exchanger, the refrigerant compressor unit may trip (resulting in train trip and restart, flaring) and large temperature gradients in the main cryogenic heat exchanger may occur, which may result in mechanical damage (tube leaks in case of a coil-wound type heat exchanger) in the main cryogenic heat exchanger. An example application is a liquefaction unit, fed by treated gas from various in-plant (train) feed sources, considering that the feeding trains trip more often.

Existing refrigerant compressor and duty controls (incl. Advanced Process Control) are designed to find the optimum (maximum LNG output, lowest specific power) operating point, whereby the fast dynamics (minutes scale) are not specifically relevant—tuning of the controls can thus be relatively "tame". The dynamic behavior (for fast variations in the flow rate of the feed gas) can be improved by adding a fast action, aiming at minimizing temperature differences in the main cryogenic heat exchanger and avoiding liquid drop out from the shell side of the main cryogenic heat exchanger, i.e. in general aiming at stabilizing the refrigerant loop and avoiding a cascade trip. It is noted that a (temporary) inefficient operation of the main cryogenic heat exchanger, in particular of the refrigerant compressor unit is acceptable. While focus here is on robustness for fast feed gas flow rate variations, the proposed control method may also allow for a stable operation during normal operations, if feed gas flow rate variations are not fast.

Observed dynamic behavior, following a relatively fast variation of the flow rate of the feed gas stream of the main cryogenic heat exchanger may be a pressure/temperature fluctuation of the mixed refrigerant at the main cryogenic heat exchanger warm mixed refrigerant outlet, fluidly connected to the suction side of the refrigerant compressor unit and/or a pressure variation at the light and heavy mixed refrigerant inlet to the main cryogenic heat exchanger, fluidly connected to the discharge side of the compressor. The pressure ratio and mixed refrigerant flow rate are linked via the compressor performance (compressor curves). The refrigerant compressor unit operating point (on the curves) can be better tuned to improve the fast dynamic response. The exact strategy depends on the refrigerant compressor unit type. The refrigerant compressor unit can be an axial machine (axial low pressure mixed refrigerant—LP MR historically) or centrifugal compressors (HMR and also new LMR compressors). Axial LP MR compressors are traditionally equipped with Variable Stator Vanes (VSV), which are effective to independently manipulate flow rate and compressor head (pressure ratio). Centrifugal compressors may have Inlet Guide Vane control. Shaft speed control is another way of controlling capacity, but is on most (single shaft GTs) not or insufficiently available. Yet another way of controlling capacity and head is to increase pressure drop by a throttling control valve in the suction and/or discharge of the compressor; the introduction of throttling control valves in suction or discharge is an inefficient way of control, because even in case the valve is fully opened (in normal operation) there will be additional pressure drop that needs to be compensated by increasing compression power.

Both axial and centrifugal compressors generally have compressor recycle valves to avoid surge; these valves can (in order to prevent surge) act very fast and cover 0-100% capacity. The principle of the currently suggested control scheme, which will be explained in more detail below with reference to the figures, is to use the existing or dedicated compressor recycle valves as primary actuators. It is noted that VSV and/or IGV control may be used in addition.

Additionally or alternatively, the suggested control scheme may also use throttling control valves positioned at the suction and/or discharge side of the refrigerant compressor unit. The common feature of the compressor recycle valves and the throttling control valves is that these allow for fast action. The compressor recycle valves are used for the explanation of the principle of the control scheme, because this is the most common configuration, allowing for the most energy efficient normal operation of the mixed refrigerant loop (because of minimum pressure loss).

In the remainder of the explanation, the term "constant" will be used, however, it will be understood that this term should be interpreted as encompassing minimum changes which may occur during steady operation and moreover encompass minimal changes induced by a general operating scheme which may actively manipulate these minimum changes to achieve a better control response.

It is assumed that the best strategy for the control scheme is: keeping the temperature profile in the main cryogenic heat exchanger (nearly) constant, following a relatively strong variation of the flow rate of the feed gas stream. This can be accomplished by keeping the pressure, temperature of the mixed refrigerant in the refrigerant loop constant, and thereby also the light mixed refrigerant stream and the heavy mixed refrigerant stream compositions constant. The light and heavy mixed refrigerant streams will be described in some more detail below, but will also be readily understood by a skilled person.

With constant pressure, temperature and light and heavy mixed refrigerant compositions, the main other single variable to change is the flow rate of mixed refrigerant through the main cryogenic heat exchanger, which is preferred to follow the feed gas stream in ratio. The mixed refrigerant flow rate to the main cryogenic heat exchanger can be manipulated by another base control scheme; for the purpose of illustration, the base control scheme as described in WO2001081845 A1 is used where the heavy mixed refrigerant flow rate is manipulated following the flow rate and temperature of the liquefied natural gas stream exiting the main cryogenic heat exchanger. The light mixed refrigerant flow rate is controlled in ratio to the heavy mixed refrigerant flow rate. With both light and heavy mixed refrigerant flow rates controlled to produce liquefied natural gas at a preset temperature, following liquid natural gas flow rate variations, the new control scheme can now match the requested light mixed refrigerant and heavy mixed refrigerant flow rate through manipulation of the recycle valve(s) (and/or speed control and/or throttling control valves in the suction and/or discharge) respecting at the same time the required constant pressure of the mixed refrigerant exiting the main cryogenic heat exchanger and of the separation vessel (for separating mixed refrigerant into light and heavy mixed refrigerant streams).

The temperature in the separation vessel can be controlled by adjusting the coolant flow and/or a portion of the mixed refrigerant bypassing heat exchangers (pre-coolers) upstream of the separation vessel, providing cooling to the compressed mixed refrigerant stream by a pre-cooling refrigerant loop, such as a propane refrigerant or a different mixed refrigerant. If, for example, a propane cycle is used as pre-cool loop, the temperature variations due to a reduced mixed refrigerant flow rate are not noticeable and no additional temperature control is needed.

According to an embodiment there is provided a method, wherein the control scheme (as described above) further comprises to keep the operating parameters of the refrigerant compressor unit (substantially) constant. According to an embodiment the control scheme does not comprise changing the operating parameters of the refrigerant compressor unit other than the recycle or throttling valves.

It is noted that keeping the operating parameters of the refrigerant compressor unit constant is the primary objective, which is to keep the pressure and temperature constant in the separation vessel 400, while adjusting the mixed refrigerant flow rate to the main cryogenic heat exchanger. In case of the recycle valves, the compressor suction and discharge will remain about constant. In case suction/discharge throttling valves are used, there will be additional dp, and the compressor suction and discharge may actually intentionally be varied to ensure the separation vessel and main cryogenic heat exchanger outlet pressure are kept constant.

As a result, the physical parameters (pressure, temperature) in the mixed refrigerant separator and at the mixed refrigerant outlet of the main cryogenic heat exchangers are kept stable, while the flow rate of the mixed refrigerant is adjusted to match the variation of the flow rate of the feed gas stream. By keeping pressure and temperature constant, as will be understood by the skilled person, all thermodynamic properties are fixed.

Keeping the operating parameters of the refrigerant compressor unit constant means keeping the operating parameters of the refrigerant compressor unit substantially equal to the operating parameters of the refrigerant compressor unit at the moment the control scheme is triggered or at the moment the variation of the flow rate exceeding a predetermined threshold value is monitored or predicted. The operating parameters may comprise the working duty, power consumption, compressor speed, the variable stator vanes, inlet guide vane control.

Controlling the recycle valve allows to respond quickly to a determined variation in the flow rate of the feed gas stream without the need to change the operating conditions of the recycle compressor unit, thereby keeping the physical parameters of the mixed refrigerant in separation vessel (for separating mixed refrigerant into light and heavy mixed refrigerant streams) or at the separation vessel inlet substantially stable. So, although not ideal from an energy consumption point of view, the method allows to respond quickly while keeping the physical parameters of the compressed mixed refrigerant, in particular the pressure and temperature of the mixed refrigerant when entering the main cryogenic heat exchanger or separation vessel (discussed below), stable, thereby not negatively influencing the temperature profile inside the main cryogenic heat exchanger.

According to an embodiment, the opening of the recycle valve is such that the variation of the mixed refrigerant flow rate through the main cryogenic heat exchanger is proportional to the variation in the flow rate of the feed gas stream. So, according to an embodiment, if the variation in the flow rate of the feed gas stream is 30%, the recycle valve is opened to generate a variation of the mixed refrigerant flow rate through the main cryogenic heat exchanger substantially equal to 30%. Because of the mixed refrigerant flow rate reduces, also the pressure drops across the tubes and shell of the main cryogenic heat exchanger will reduce, impacting the thermodynamic equilibrium/composition of light mixed refrigerant and heavy mixed refrigerant to "some extent". This is the main reason why the temperature profile cannot be kept exactly "constant", however, the control scheme can be tuned to minimize the temperature profile in the main cryogenic heat exchanger. In an embodiment, the mixed refrigerant outlet temperature, the LMR, and/or HMR temperatures and natural gas streams at various locations in and/or around the MCHE can be measured (the temperature profile) and used by the control scheme to (slightly) adjust the said operating conditions in the MR separator and/or the MCHE mixed refrigerant outlet. It is a particular advantage of the control scheme that the measurements can be used by the controller to control the temperature profile in the MCHE.

According to an embodiment there is provided a method, wherein the predetermined threshold value is at least one of

- a decrease of flow rate at a rate of change of at least 1% per minute
- a decrease of flow rate at a rate of change of at least 5% per minute
- a decrease of flow rate at a rate of change of at least 15% per minute.

According to this embodiment the predetermined threshold value is a rate of change of the flow rate for any time span of that rate-of change.

According to a further embodiment, the predetermined threshold value is an absolute flow rate value.

For instance, a flow rate change (expressed as kg/s per minute, e.g. 15 kg/s per minute) and/or an absolute flow rate (in kg/s, e.g. 10% of 150 kg/s=15 kg/s) could be used to trigger the control loop.

According to another embodiment, the threshold value is a combination of the rate-of-change threshold to be present for at least a certain threshold time span or resulting in at least a certain variation in flow rate. The selection of (combinations of) threshold values is not limited by the capability of the control scheme. The limitations are merely the result of existing alternatives control schemes. For example, the rate-of-change threshold can be selected very low (lower than 1% per minute) possibly in combination with a very low absolute flow change threshold—in this extreme, the control scheme would (almost) always be active, which will result in a stable operation, however competing with more energy efficient control schemes, which are effective at small and slow moving variations in feed stream flows.

According to an embodiment there is provided a method, wherein variations in the flow rate can be monitored by performing measurements on the feed gas stream flowing to the inlet of the main cryogenic heat exchanger.

It will be understood that many alternatives are available for monitoring the flow rate of the feed gas stream at an inlet of the main cryogenic heat exchanger can be applied, by monitoring parameters which are related thereto, such as measuring the flow rate of a feed gas stream being discharged by the main cryogenic heat exchanger, or measuring temperature and/or pressure values in the mixed refrigerant loop, such as measuring the pressure of the mixed refrigerant loop at a separation vessel inlet (also referred to light/heavy mixed refrigerant separator, described in more detail below).

Measuring a flow rate may be done with any suitable measurement device. As indicated above, the flow rate may be the volumetric flow rate or the mass flow rate.

According to an embodiment there is provided a method, wherein variations in the flow rate can be predicted based on signals indicating a variation in the flow rate, such as trip signals or shut-down signals, received from equipment positioned upstream of the main cryogenic heat exchanger, such as gas treatment equipment or liquefaction trains from which part of the feed gas stream is received.

This embodiment has the advantage that a variation in the flow rate can be predicted before it actually occurs at the inlet of the main cryogenic heat exchanger, thereby allowing for a quick and timely triggering of the control scheme.

According to an embodiment there is provided a method, wherein the control scheme comprises

- monitoring one or more pressure values of the mixed refrigerant at one or more predetermined locations in the refrigerant loop, and
- controlling the one or more compressor recycle valves comprises controlling the one or more compressor recycle valves in response to the one or more pressure values.

Monitoring one or more pressure values of the mixed refrigerant in the refrigerant loop provides a relatively easy to implement and reliable method to ensure the mixed refrigerant stream entering the main cryogenic heat exchanger is substantial identical to the mixed refrigerant stream entering the main cryogenic heat exchanger prior to starting the control scheme, except for the flow rate thereof, which is preferably decreased in proportion to the decrease of the flow rate of the feed gas stream entering the main cryogenic heat exchanger.

According to an embodiment there is provided a method, wherein the refrigerant loop further comprises a separation vessel having a separation vessel inlet fluidly connected to the discharge side of the compressor unit to receive the compressed mixed refrigerant stream and discharge a light mixed refrigerant stream and a heavy mixed refrigerant stream.

It will be understood that additional equipment may be present in between the discharge side of the compressor unit and the separation vessel inlet, such as heat exchangers, also referred to as pre-coolers, that provide cooling to the compressed mixed refrigerant stream. The heat exchangers may be cooled by a pre-cooling refrigerant loop, such as a propane refrigerant or a different mixed refrigerant, wherein the pre-cooling refrigerant loop may also be used to pre-cool the feed gas stream upstream of the main cryogenic heat exchanger.

The skilled person will understand that the heavy and light mixed refrigerant streams are passed through the main cryogenic heat exchanger in parallel through refrigerant tubes. The heavy mixed refrigerant is discharged from the main cryogenic heat exchanger at a mid-level (seen in vertical direction), expanded, thereby cooled and re-introduced at the mid-level into the main cryogenic heat exchanger at the shell side to provide cooling to the feed gas stream, and the heavy and light mixed refrigerant flowing through the refrigerant tubes.

The light mixed refrigerant is discharged from the main cryogenic heat exchanger at a top-level (seen in vertical direction), expanded, thereby cooled and re-introduced at the top-level into the main cryogenic heat exchanger at the shell side to provide cooling to the feed gas stream, and the heavy and light mixed refrigerant flowing through the refrigerant tubes.

According to an embodiment there is provided a method, wherein monitoring one or more pressure values of the mixed refrigerant in the refrigerant loop comprises monitoring a first pressure value of the compressed mixed refrigerant stream at the separation vessel inlet.

According to an embodiment there is provided a method, wherein controlling the one or more compressor recycle valve(s) in response to the pressures of the mixed refrigerant is done to keep the first pressure at a setpoint pressure value or wherein controlling the one or more compressor recycle valve(s) in response to the pressures of the mixed refrigerant is done to keep the first pressure below a predefined setpoint pressure value.

The set point pressure value may be a predetermined value.

The set point pressure value may alternatively be the first pressure value substantially equal to the first pressure value at the at the moment the control scheme is triggered or at the moment the variation of the flow rate exceeding a predetermined threshold value is monitored or predicted.

The term substantial equal to is used in this text to indicate that a value differs less than 10%, preferably less than 5% and more preferably less than 1% from the value it is substantial equal to.

An advantage of this control scheme is that once the flow rate of the feed gas stream progresses back to normal, the control scheme will follow this by closing the recycle valve.

This embodiment has the further advantage that by keeping the pressure and preferably the temperature, the latter the resultant of the cooling duty of the pre-coolers, of the compressed mixed refrigerant stream at the separation vessel inlet constant, the composition of the light and heavy mixed refrigerant streams, as well as the flow ratio of the light and heavy mixed refrigerant, after triggering the control scheme will be similar to the compositions of the light and heavy mixed refrigerant streams before triggering the control scheme, thereby maintaining the temperature profile of the main cryogenic heat exchanger and keeping the liquid hold up in the separator vessel substantially constant.

This is especially the case in situations wherein the compressed mixed refrigerant stream is passed through heat exchangers (pre-coolers) that provide cooling to the compressed mixed refrigerant stream which are a pre-cooling refrigerant loop as described above, such as a propane refrigerant or a different mixed refrigerant. In such a situation, the temperature of the compressed mixed refrigerant stream at the separation vessel inlet is relatively well-defined and constant. By keeping the first pressure at the setpoint pressure value, the compressed mixed refrigerant stream is fully defined and it is ensured that the composition of the heavy and light mixed refrigerant stream are kept constant as well.

According to an embodiment there is provided a method, further comprising monitoring a second pressure of the mixed refrigerant stream at the suction side of the compressor unit. In this case, the suction side may be up or downstream of the liquid knock-out vessel 205, but upstream a possible throttling control valve in the suction side.

According to an embodiment there is provided a method, wherein controlling the one or more compressor recycle valve(s) in response to the pressures of the mixed refrigerant is done to keep a ratio of the first pressure to the second pressure at a set point pressure ratio value.

The set point pressure ratio value may be a predetermined value.

The set point pressure ratio value may alternatively be substantial equal to a pressure ratio value at the moment the control scheme is triggered or at the moment the variation of the flow rate exceeding a predetermined threshold value is monitored or predicted.

A further advantage of this control scheme is that once the flow rate of the feed gas stream progresses back to normal, the control scheme will follow this by closing the recycle valve.

Below, a further explanation is provided with reference to the Figures.

FIG. 1 schematically depicts an embodiment of a main cryogenic heat exchanger 100 for use in a natural gas liquefaction process or plant. The main cryogenic heat exchanger 100 comprises an inlet arranged to receive a feed gas stream 1 at a flow rate F. A flow rate measuring device F may be provided. The main cryogenic heat exchanger 100 further comprises a plurality of gas tubes 2 (only one being depicted for clarity) and an outlet for discharging a cooled gas stream 3.

FIG. 1 further shows a refrigerant loop for cycling a mixed refrigerant. The mixed refrigerant may comprise a mixture of methane, ethane, propane, butane and nitrogen. However, it will be understood that additional components may be present and one or more of the listed components may be missing.

The refrigerant loop comprises at least a refrigerant compressor unit 200 comprising a suction side 201 and a discharge side 202. In use, a compressed mixed refrigerant stream is discharged from the discharge side. This streams is eventually passed through the main cryogenic heat exchanger 100 to allow the mixed refrigerant to exchange heat with the feed gas stream in the main cryogenic heat exchanger and thereby cool the feed gas stream.

In more detail, refrigerant compressor unit 200 comprises two serial compressors 203 with two associated more after-coolers 204.

Further provided is a liquid knock-out vessel 205 positioned upstream of the compressors 203 to prevent liquid entering the compressors 203.

The refrigerant compressor unit 200 generates a compressed mixed refrigerant stream 206 which is passed through a number of heat exchangers 300 which are cooled by a pre-cooling refrigerant loop, such as a propane refrigerant or a different mixed refrigerant. The pre-cooling refrigerant may also be used, in pre-coolers, to pre-cool the feed gas stream 1 upstream of the main cryogenic heat exchanger 100. Thereby a cooled compressed refrigerant stream 301 is obtained which is passed to a separation vessel 400 via a separation vessel inlet 401.

In the separation vessel 400 the vapor/liquid phase are separated, here referred to light mixed refrigerant (LMR)/heavy mixed refrigerant (HMR). The separation vessel 400 may also be referred to as a light/heavy mixed refrigerant separator.

The heavy mixed refrigerant (HMR) stream 402 is drawn from the bottom and the light mixed refrigerant (LMR) stream 403 flows to the top. The heavy mixed refrigerant stream 402 flows into the bottom part of the warm bundle of the main cryogenic heat exchanger to be subcooled before being expanded in a liquid expander and/or a Joule Thomson (JT) valve 111 and being introduced into the shell side of the main cryogenic heat exchanger 100.

The light mixed refrigerant stream 403 is passed into the bottom part of the warm bundle of the main cryogenic heat exchanger 100 to be condensed and subcooled before being expanded in a liquid expander and/or a Joule Thomson valve 121 and being introduced into the shell side of the main cryogenic heat exchanger 100. Optionally, part of the light mixed refrigerant stream 403 may be split-off to be liquefied in a separate heat exchanger against end flash gas (not shown), expanded in a liquid expander and/or a Joule Thomson valve and being introduced into the shell side of the main cryogenic heat exchanger together with the other stream.

Both the heavy and the light mixed refrigerant streams flow down through the shell side of the main cryogenic heat exchanger 100, providing cooling duty to the feed gas stream 2 and the light and heavy mixed refrigerant stream 120, 110 flowing through the tube side. The light and heavy mixed refrigerant streams mix in the shell side of the main cryogenic heat exchanger and are collected at the bottom of the main cryogenic heat exchanger 100 as collected stream 130 and passed to the refrigerant compressor unit 200, in particular to the liquid knock-out vessel 205 positioned upstream of the compressors 203. In normal operation, the mixed refrigerant entering vessel 205 contains no liquid. The vessel 205 is provided to accumulate incidental liquids to allow for a shutdown of the compressor before liquid can enter the compressor 203.

Figure 2:
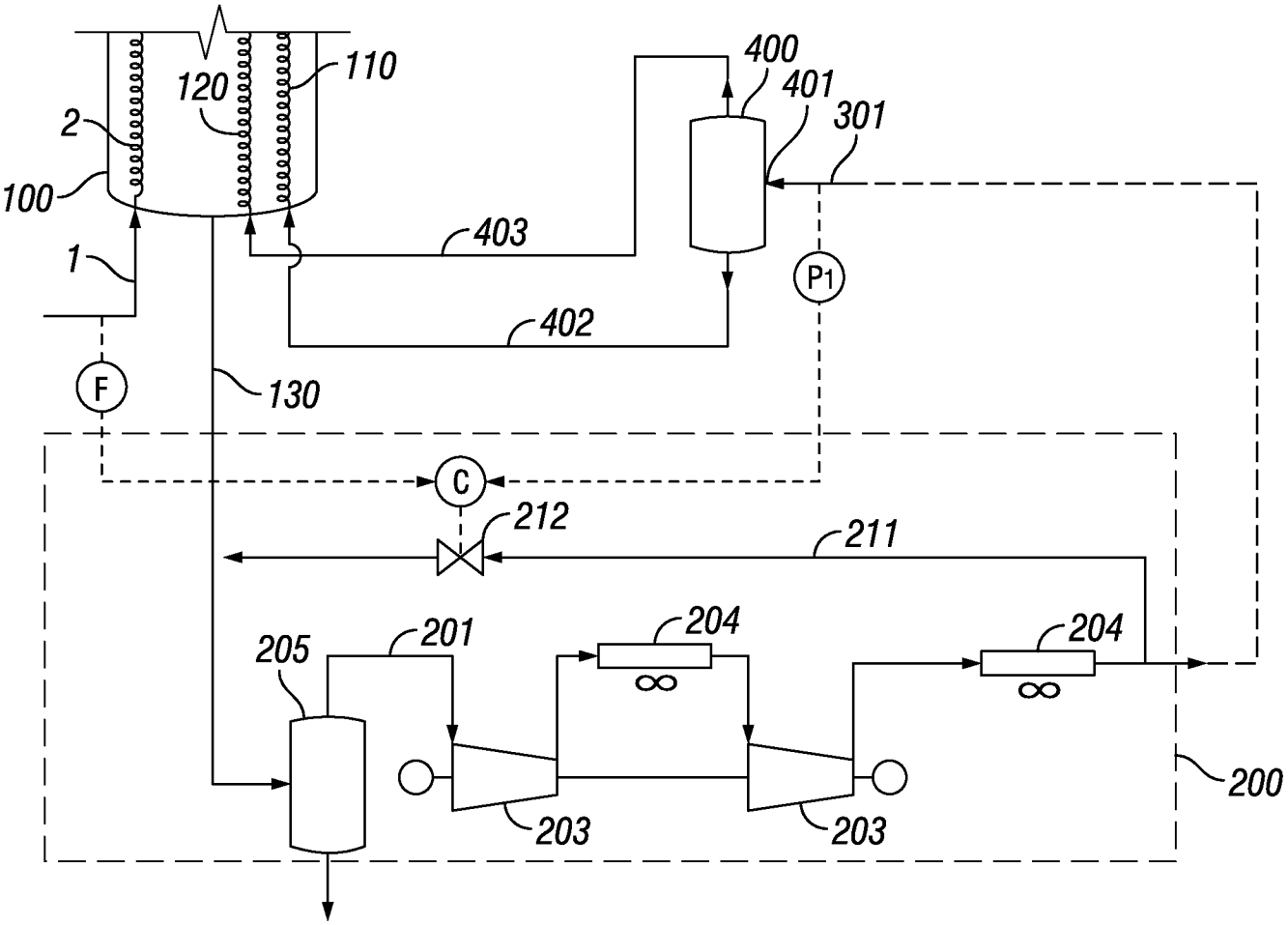
FIG. 2 is a schematic illustration of a main cryogenic heat exchanger and the associated refrigerant loop of another embodiment of the present invention.
Figure 3:
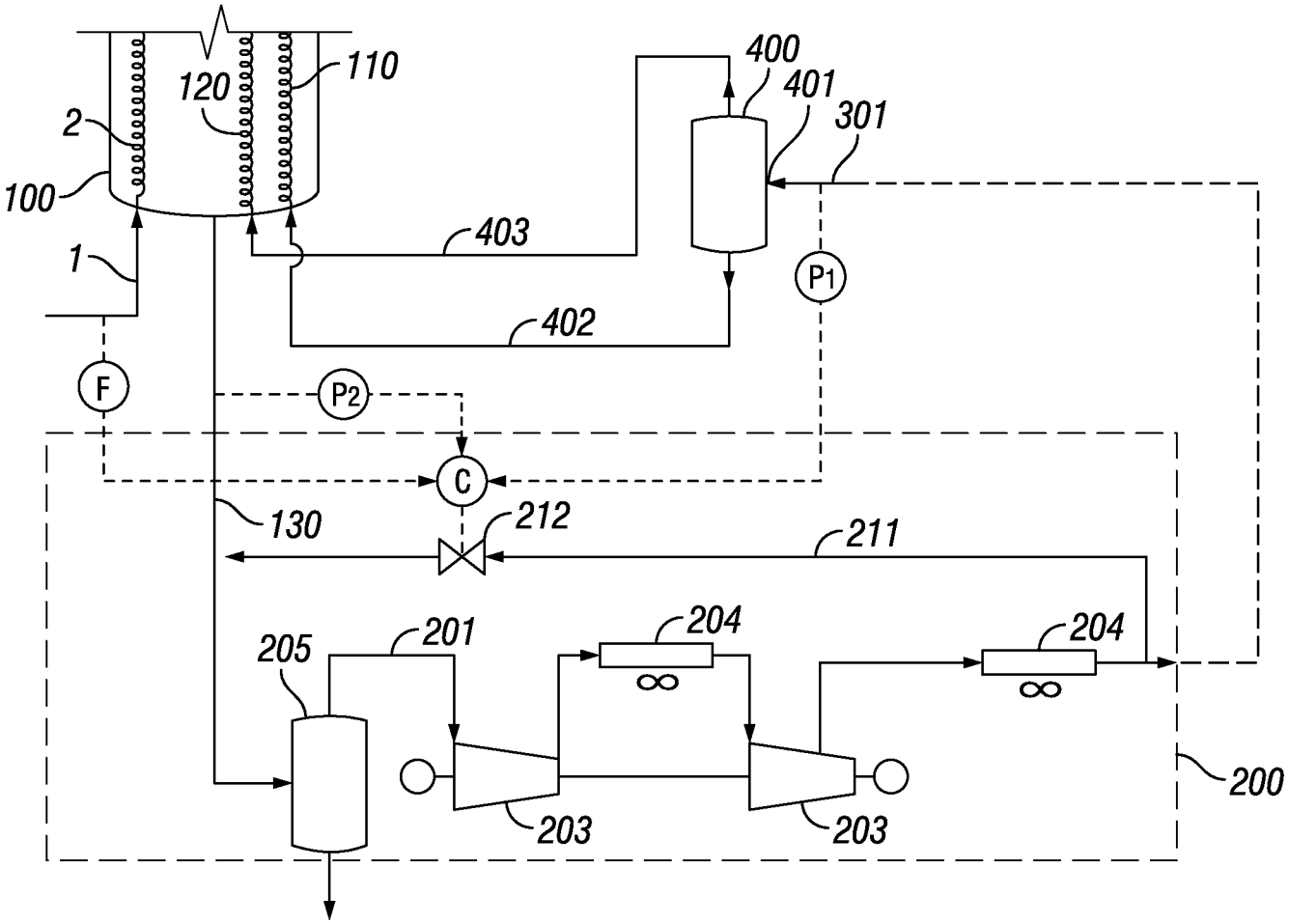
FIG. 3 is a schematic illustration of a main cryogenic heat exchanger and the associated refrigerant loop of a further embodiment of the present invention.
Figure 4:
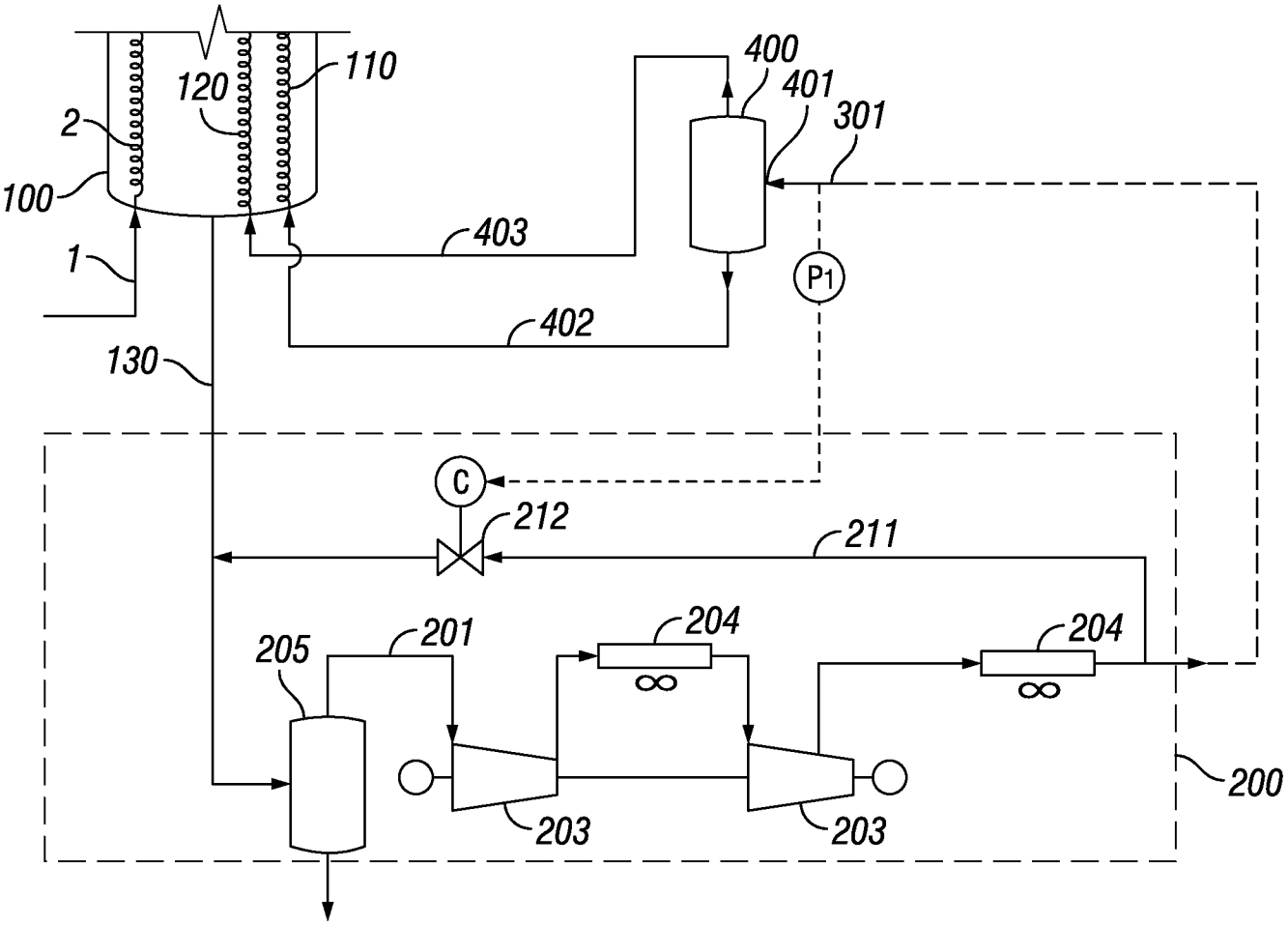
FIG. 4 is a schematic illustration of a main cryogenic heat exchanger and the associated refrigerant loop of yet another embodiment of the present invention.

FIGS. 2-4 show alternative embodiments, all comprising a recycle line 211 connecting a discharge side of the refrigerant compressor unit to a suction side of the refrigerant compressor unit, the recycle line 211 comprising a controllable compressor recycle valve 212. The recycle line 211 is arranged to convey mixed refrigerant. The recycle line 211 can be fluidly connected upstream or downstream the liquid knock-out vessel 205.

The methods described here are related to operating the main cryogenic heat exchanger, including the associated refrigerant loop during transient feed gas streams 1.

The method comprises monitoring or predicting variations in the flow rate F of the feed gas stream 1 and in case a variation of the flow rate F exceeding a predetermined threshold value is monitored or predicted, starting a control scheme which control scheme comprises controlling the compressor recycle valve 211 in response to the monitored or predicted variation of the flow rate to recycle part of the compressed mixed refrigerant stream 206 from the discharge side 202 to the suction side of the compressor unit 200.

Different embodiments for controlling the recycle valve 212 will be provided below with reference to FIGS. 2-4. The control scheme may be executed by a controller C, which is arranged to receive one or more measurement signals, process these signals according and thereby generate one or more control signals to control the recycle valve 212. The controller C may be a dedicated controller or may be embedded in a larger controller for controlling other parts of the compressors 203, main cryogenic heat exchanger, refrigerant loop. The flow rate F may be measured by any suitable measurement device.

The methods may result in a) stable first pressure P1 at the separation vessel inlet, which first pressure P1 is set at a setpoint pressure value (or nominal value) substantially equal to the pressure at the separation vessel inlet during normal operation before the transient. This embodiment will be described in more detail with reference to FIG. 2.

b) stable pressure ratio of the first pressure P1 at the separation vessel inlet and a second pressure P2 at the suction side of the compressor unit. The control scheme comprises keeping the ratio of the first to the second pressure at a set point pressure ratio value which is substantially equal to such a ratio during normal operation. This embodiment will be described in more detail with reference to FIG. 3.

c) control of first pressure P1 at the separation vessel inlet, which first pressure P1 is kept below a predefined maximum value, the controller allows the first pressure to increase to a maximum predefined setpoint and prevents exceeding this maximum predefined setpoint pressure value by controlling the recycle valve 212. This embodiment will be described in more detail with reference to FIG. 4.

The recycle valve may be controlled as follows. The skilled person will understand that for fixed compressor variable stator vanes, inlet guide vanes, and/or shaft speed, there is a relation between flow rate and pressure ratio, often referred to as "compressor curve". The compressor curve for most compressors shows a decreasing pressure ratio developed by the compressor for an increasing volumetric flow rate at the compressor suction. In case pressure p1 (or pressure ratio p1 over p2) would increase, this is an indication that the flow rate through the compressor is too low. The controller C would correct this by further opening valve 212 to increase the flow rate through the compressor. Likewise, a decreasing p1 (or ratio p1 over p2), indicates a too high flow rate through the compressor, and controller C would further close control valve 212 to reduce the flow through the compressor.

FIG. 2 relates to an embodiment in which the controller C executes a control scheme, which control scheme comprises monitoring a first pressure value P1 of the compressed mixed refrigerant stream at the separation vessel inlet 401, and controlling the compressor recycle valve 212 in response to the first pressure value P1 to keep the first pressure P1 at a setpoint pressure value.

The control scheme described with reference to FIG. 2, when activated and set in automatic mode; the controller C manipulates the compressor recycle valve 212 to maintain the first pressure at the setpoint pressure value.

In normal operation, i.e. before triggering of the control scheme, the controller C is inactive and set in manual mode, with its setpoint tracking the first pressure P1. A reduction in the feed gas stream 1 by more than a predefined threshold, dependent on control intent can range from 0 to 30%, the controller C is automatically activated or triggered. This activation locks the first pressure P1 at the first pressure value P1 prior to the natural gas stream flow rate reduction. The controller C can be inactivated or disengaged when the recycle valve opening drops below a predefined threshold, dependent on control intent can range from 0 to 20%. The controller C is then ready to be re-activated or re-triggered by another significant gas stream flow reduction. This inactivation can be performed either manually remotely, by an operator or automatically through the implemented logic at the compressor control module. A secondary function of the controller is the closing the recycle valve 212 if the compressor speed is reduced or changed, which may be the case when a refrigerant compressor unit efficiency optimization is performed (e.g. performed by a human operator) to optimize the operation in view of the new feed gas stream flow rate. The (human) operator may change other set points of the relatively slow control schemes (LMR/HMR ratio, shaft speed, VSVs, IGVs etc.) to increase the efficiency of the loop, which is visible through automatic closing of the recycle valve and reduction of the refrigerant compressor unit driver power. FIG. 2 may also relate to an embodiment in which the controller C executes a control scheme, which control scheme comprises monitoring a first pressure value P1 of the compressed mixed refrigerant stream at the separation vessel inlet 401, and controlling the compressor recycle valve 212 in response to the first pressure value P1 to keep the first pressure P1 below a predefined setpoint pressure value.

In embodiments, in which variations in the flow rate of the feed gas stream 1 are monitored by measuring the first pressure P1 of the mixed refrigerant loop at a separation vessel inlet 401, this provides the advantage that only the first pressure value P1 needs to be determined, for triggering the control scheme (starting to manipulate recycle valve 212) as well as performing the control scheme. Measurement device F as shown in FIG. 2 may then be omitted.

This embodiment results in a stable first pressure P1 below a predefined setpoint pressure value. The proposed control method utilizes a maximum pressure controller that manipulates the compressor recycle valve(s) to prevent the first pressure from exceeding the predefined setpoint pressure value at which the pressure relief valve or other mechanisms are engaged to avoid exceeding a mechanical design pressure of piping and/or equipment. Usually these mechanisms result in a shutdown of the mixed refrigerant loop and shutdown of LNG production.

FIG. 3 relates to an embodiment in which the controller C executes a control scheme, which control scheme in addition comprises monitoring a second pressure P2 of the mixed refrigerant stream at the suction side 201 of the compressor unit 200 and controlling the compressor recycle valve 212 to keep a ratio of the first pressure P1 to the second pressure P2 at a set point pressure ratio value.

This results in a stable pressure ratio at points P1:P2 to a set point pressure ratio value that corresponds to a pressure ratio associated with normal operations. Referring to the control scheme associated with FIG. 3, when activated and set in automatic mode, the controller C manipulates the compressor recycle valve 212 to maintain the ratio at the set point pressure ratio. During normal operation, the controller C is inactive and set to manual mode with its setpoint tracking the ratio of the pressure measurements of the first and second pressures values. A reduction in the flow rate of the gas stream by more than the predetermined threshold value, the controller C is automatically activated or triggered. This activation locks the set point pressure ratio value at the pressure ratio value prior to the gas stream flow reduction. The controller C can be inactivated or disengaged when the recycle valve opening drops below a predefined threshold, dependent on control intent can range from 0 to 20%. The controller is then ready to be re-activated or re-triggered by another significant natural gas stream flow reduction. This inactivation can be performed either manually remotely, by an operator or automatically through the implemented logic at the compressor control module. A secondary function of the controller is the closing the recycle valve 212 if the compressor speed is reduced or changed, which may be the case when a refrigerant compressor unit efficiency optimization is performed (e.g. performed by a human operator) to optimize the operation in view of the new feed gas stream flow rate.

Figure 5:
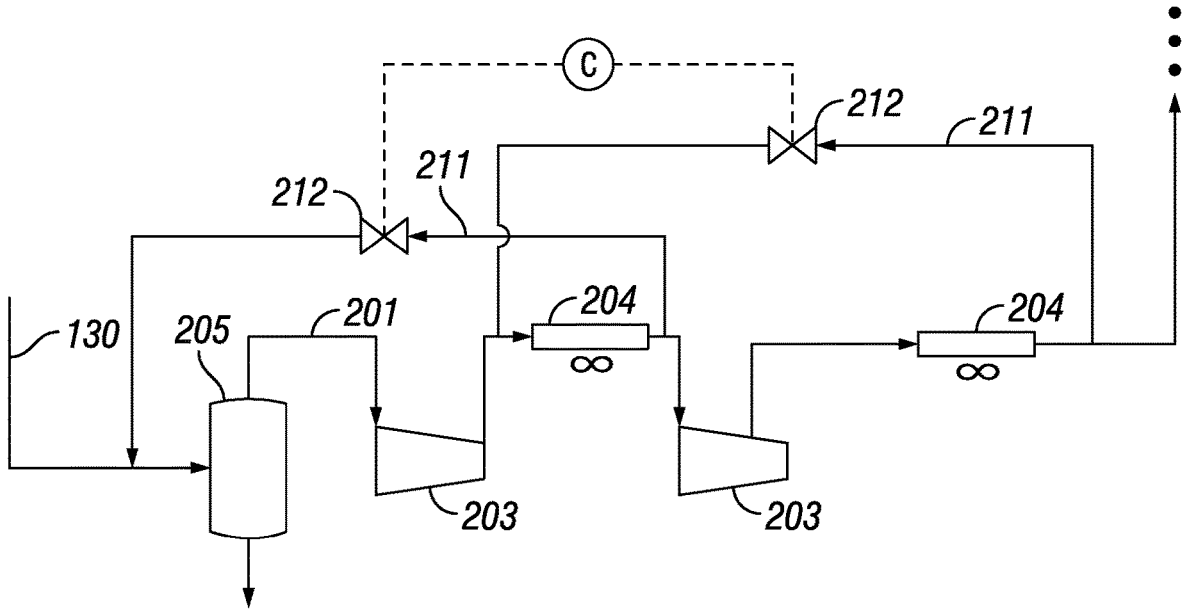
FIG. 5 is a schematic illustration of still another embodiment of the present invention depicting an example of more than one recycle valve.

According to an embodiment, more than one recycle valve is provided, each recycle valve being associated with one or more compressors being comprised by the refrigerant compressor unit. An example thereof is schematically shown in FIG. 5, showing a first recycle valve 212 and a first recycle line 211 providing a recycle over a first compressor 203 and associated aftercooler 204 (and vessel 205), and a second a second recycle valve 212' and a second recycle line 211' providing a recycle over a second compressor 203' and associated aftercooler 204'. Preferably, as shown, the second recycle valve 212' and recycle line 211' provide a recycle over the first aftercooler 204.

Referring to relevant embodiments a recycle valve opening requested by the control methods can be considered as an overall opening request potentially acting on a single recycle valve or multiple recycle valves. The latter situations applies to embodiments wherein the refrigerant compressor units comprise two or more compressors and two or more recycle valves and associated recycle lines are provided. The number of recycle valves and associated recycle lines may be equal or less than the number of compressors.

The overall request can be funneled onto all recycle valves at once, or staggered one-by-one.

It is recognized that an additional liquefaction train may also be added to a single treatment and liquefaction train. The additional feed stream may comprise any combination of the above disclosed streams taken from the (single) treatment and liquefaction trains, such as end flash.

Furthermore, the following embodiments are provided:

Method to control a liquefaction process of a gas stream, the method comprising the steps of:

providing a (treated) gas stream to at least one first liquefaction train;

controlling a refrigerant compressor of the first liquefaction train depending on at least one parameter of the treated gas stream.

The method may further comprise the step of:

providing a gas stream to at least one second liquefaction train having a treatment section for treating the gas stream and providing the treated gas stream.

The at least one parameter of the treated gas stream includes one or more of: temperature, flow rate and pressure difference. The pressure difference may include a pressure difference over a main cryogenic heat exchanger of the first liquefaction train and/or the second liquefaction train.

System to control a liquefaction process of a gas stream, the system comprising:

at least one first liquefaction train having a refrigerant compressor;

a first supply system for providing a treated gas stream to the at least one first liquefaction train; and a controller for controlling the refrigerant compressor of the at least one first liquefaction train depending on at least one parameter of the treated gas stream.

The system may further comprise:

a second supply system for providing a gas stream;

at least one second liquefaction train having a treatment section for treating the gas stream and for providing the treated gas stream.

The at least one parameter of the treated gas stream includes one or more of: temperature, flow rate and pressure difference. The pressure difference includes a pressure difference over a main cryogenic heat exchanger of the first liquefaction train and/or the second liquefaction train.

The present disclosure is not limited to the embodiments as described above and the appended claims. Many modifications are conceivable and features of respective embodiments may be combined.

The invention claimed is:

1. A method of operating a main cryogenic heat exchanger for use in a natural gas liquefaction process, the method comprising:

receiving a feed gas stream at an inlet of the main cryogenic heat exchanger at a flow rate, cycling a mixed refrigerant through a refrigerant loop, the refrigerant loop comprising at least a refrigerant compressor unit comprising a suction side and a discharge side, wherein cycling comprises discharging a compressed mixed refrigerant stream from the discharge side and passing the mixed refrigerant through the main cryogenic heat exchanger to allow the mixed refrigerant to exchange heat with the feed gas stream in the main cryogenic heat exchanger and thereby cool the feed gas stream, wherein the method further comprises monitoring or predicting variations in the flow rate of the feed gas stream; and in case a variation of the flow rate exceeding a predetermined threshold value is monitored or predicted, starting a control scheme which control scheme comprises monitoring one or more pressure values of the mixed refrigerant at one or more predetermined locations in the refrigerant loop; and controlling one or more compressor recycle valves in response to the monitored or predicted variation of the flow rate and in response to the one or more pressure values to recycle part of the compressed mixed refrigerant stream.

2. The method according to claim 1, wherein the control scheme further comprises to keep operating parameters of the refrigerant compressor unit constant.

3. The method according to claim 1, wherein the predetermined threshold value is at least one of:

a decrease of flow rate at a rate of change of at least 1% per minute;

a decrease of flow rate at a rate of change of at least 5% per minute;

a decrease of flow rate at a rate of change of at least 15% per minute.

4. The method according to claim 1, wherein variations in the flow rate can be monitored by performing measurements on the feed gas stream flowing to the inlet of the main cryogenic heat exchanger.

5. The method according to claim 1, wherein variations in the flow rate can be predicted based on signals indicating a variation in the flow rate, received from equipment positioned upstream of the main cryogenic heat exchanger.

6. The method according to claim 1, wherein the refrigerant loop further comprises a separation vessel having a separation vessel inlet fluidly connected to the discharge side of the compressor unit to receive the compressed mixed refrigerant stream and discharge a light mixed refrigerant stream and a heavy mixed refrigerant stream.

7. The method according to claim 1, wherein monitoring one or more pressure values of the mixed refrigerant in the refrigerant loop comprises monitoring a first pressure value of the compressed mixed refrigerant stream at the separation vessel inlet.

8. The method according to claim 7, wherein controlling the one or more compressor recycle valves in response to the one or more pressure values of the mixed refrigerant is done to keep the first pressure at a setpoint pressure value or wherein controlling the one or more compressor recycle valves in response to the one or more pressure values of the mixed refrigerant is done to keep the first pressure below a predefined setpoint pressure value.

9. The method according to claim 7, further comprising monitoring a second pressure of the mixed refrigerant stream at the suction side of the compressor unit.

10. The method according to claim 9, wherein controlling the one or more compressor recycle valves in response to the one or more pressure values of the mixed refrigerant is done to keep a ratio of the first pressure to the second pressure at a set point pressure ratio value.

11. A system for use in a natural gas liquefaction process, the system comprising a main cryogenic heat exchanger for receiving a feed gas stream at an inlet of the main cryogenic heat exchanger at a flow rate, a refrigerant loop comprising at least a refrigerant compressor unit comprising a suction side and a discharge side, wherein the refrigerant loop is arranged to cycle a mixed refrigerant through the refrigerant loop, wherein cycling comprises discharging a compressed mixed refrigerant stream and passing the mixed refrigerant through the main cryogenic heat exchanger to allow the mixed refrigerant to exchange heat with the feed gas stream in the main cryogenic heat exchanger and thereby cool the feed gas stream, the refrigerant loop further comprising one or more compressor recycle valves and associated recycle lines arranged to recycle part of the compressed mixed refrigerant stream, wherein the system further comprises a controller arranged to monitor or predict variations in the flow rate of the feed gas stream, determine a monitored or predicted variation of the flow rate exceeding a predetermined threshold value and in response thereto, monitor one or more pressure values of the mixed refrigerant at one or more predetermined locations in the refrigerant loop; and start a control scheme which control scheme comprises controlling the one or more compressor recycle valves in response to the monitored or predicted variation of the flow rate and in response to the one or more pressure values to recycle part of the compressed mixed refrigerant stream.

12. The method according to claim 5, the signals indicating a variation in the flow rate being trip signals or shutdown signals.

13. The method according to claim 5, the equipment positioned upstream of the main cryogenic heat exchanger being gas treatment equipment or liquefaction trains from which part of the feed gas stream is received.

* * * * *